US010738395B2

(12) United States Patent
Chand et al.

(10) Patent No.: US 10,738,395 B2
(45) Date of Patent: Aug. 11, 2020

(54) MULTIFILAMENT FIBER AND METHOD OF MAKING SAME

(71) Applicant: INVISTA NORTH AMERICA S.A.R.L., Wilmington, DE (US)

(72) Inventors: Subhash Chand, Elgin, SC (US); Ali Sayed Fareed, Kennesaw, GA (US)

(73) Assignee: INVISTA North America S.a.r.l., Wilmington, DE (US)

( * ) Notice: Subject to any disclaimer, the term of this patent is extended or adjusted under 35 U.S.C. 154(b) by 867 days.

(21) Appl. No.: 15/034,342

(22) PCT Filed: Nov. 4, 2014

(86) PCT No.: PCT/US2014/063862

§ 371 (c)(1),
(2) Date: May 4, 2016

(87) PCT Pub. No.: WO2015/066689

PCT Pub. Date: May 7, 2015

(65) Prior Publication Data

US 2016/0289866 A1 Oct. 6, 2016

Related U.S. Application Data

(60) Provisional application No. 61/899,534, filed on Nov. 4, 2013.

(51) Int. Cl.
*D01D 5/253* (2006.01)
*A41D 13/00* (2006.01)
(Continued)

(52) U.S. Cl.
CPC ..... *D01D 5/253* (2013.01); *A41D 13/0012* (2013.01); *A41D 13/0058* (2013.01);
(Continued)

(58) Field of Classification Search
CPC . D01D 5/30; D01D 5/36; D01D 5/253; D01F 8/12; D01F 8/14; D10B 2331/04; D10B 2331/02
See application file for complete search history.

(56) References Cited

U.S. PATENT DOCUMENTS 3,492,368 A 1/1970 Coover et al.
3,525,134 A 8/1970 Coon
(Continued)

FOREIGN PATENT DOCUMENTS

EP 2748259 A1 7/2014
WO 2003/002956 A1 1/2003
(Continued)

OTHER PUBLICATIONS

International Search Report and Written Opinion Received for PCT Application No. PCT/US2014/063862, dated Jan. 30, 2015, 14 pages.
(Continued)

*Primary Examiner* — Holly C Rickman
(74) *Attorney, Agent, or Firm* — Invista North America S.A.R.L.

(57) ABSTRACT

A multipolymer fiber comprising a polyester phase formed from at least one polyester resin, present at between about 50 to about 95 percent by weight and a polyamide phase formed from at least one polyamide resin, present at between about 5 to about 50 percent by weight, wherein the polyamide phase is distinct from the polyester phase and comprises a plurality of polyamide fibrils dispersed in the polyester phase, and wherein the polyamide fibrils are separately distinguishable from each other.

52 Claims, 4 Drawing Sheets

(51) Int. Cl.

| | |
|---|---|
| ***D01F 6/90*** | (2006.01) |
| ***D01F 6/92*** | (2006.01) |
| ***D02G 3/44*** | (2006.01) |
| ***A41D 13/005*** | (2006.01) |

(52) U.S. Cl.
CPC ..... *D01F 6/90* (2013.01); *D01F 6/92* (2013.01); *D02G 3/445* (2013.01); *D10B 2331/02* (2013.01); *D10B 2331/04* (2013.01)

(56) References Cited

U.S. PATENT DOCUMENTS

| | | | | |
|---|---|---|---|---|
| 3,546,063 | A | 12/1970 | Breen | |
| 3,762,564 | A | 10/1973 | Weedon et al. | |
| 4,518,744 | A * | 5/1985 | Brody | D01D 5/28 264/176.1 |
| 5,108,684 | A | 4/1992 | Anton et al. | |
| 5,445,884 | A * | 8/1995 | Hoyt | D01D 5/253 428/370 |
| 5,464,676 | A | 11/1995 | Hoyt et al. | |
| 5,582,913 | A | 12/1996 | Simons | |
| 6,090,494 | A | 7/2000 | Rao | |
| 6,132,839 | A | 10/2000 | Reader | |
| 6,780,941 | B2 | 8/2004 | Studholme et al. | |
| 9,765,217 | B2 * | 9/2017 | Lim | C08L 77/00 |
| 2002/0123576 | A1 | 9/2002 | Studholme et al. | |
| 2002/0155290 | A1 * | 10/2002 | Figuly | D01D 5/253 428/373 |
| 2013/0280486 | A1 * | 10/2013 | Zafiroglu | A47G 27/02 428/141 |

FOREIGN PATENT DOCUMENTS

| | | | |
|---|---|---|---|
| WO | 2013/030024 | A1 | 3/2013 |
| WO | 2013/133640 | A1 | 9/2013 |
| WO | 2015/066689 | A1 | 5/2015 |

OTHER PUBLICATIONS

International Preliminary Report on Patentability Report Received for PCT Patent Application No. PCT/US2014/063862, dated May 10, 2016, 12 pages.

* cited by examiner

10

MULTIFILAMENT FIBER AND METHOD OF MAKING SAME

FIELD OF THE INVENTION

The invention relates to synthetic fibers formed from multiple polymers useful in various end uses including but not limited to yarns, airbag fiber, BCF fiber, carpet fiber, carpets, fabric and apparel.

BACKGROUND OF THE INVENTION

Polymers have long been the most prevalent material used for forming yarns for use in the carpet industry. In recent years, polyester has become a desirable polymer for use in carpet fiber.

Carpets made from polyester, particularly polyethylene terephthalate, are superior in terms of acid dye stain resistance, an important attribute, and they generally do well in terms of texture retention (durability) and soil resistance compared to the other low cost alternative, polyolefin (e.g. polypropylene). However, carpets made from polyester, particularly polyethylene terephthalate, perform quite poorly in terms of texture retention (durability) and soil resistance compared to polyamides, including nylon 66 and nylon 6, and wool. As a result, applications for polyester fibers in carpeting are often limited to those channels in which the poor durability and accelerated soiling attributes are minimized, for example in a low foot traffic residential environment. However, in high traffic environments, such as commercial office buildings, airports and schools, polyester fibers have not been considered durable enough for flooring installations. The negative aspects of polyester fiber performance in carpeting applications is, however, offset by the attractiveness of the price of polyester, which is typically favorable as a raw material due to the high supply volume of polyester raw materials.

There is, therefore, a need to improve the performance of polyester fibers for carpet applications that overcomes its durability and soiling deficiencies. The combination of polyamide and polyester resins has been contemplated to either reduce cost (of polyamide) or to improve the final carpet fiber properties (of polyester). However, the relative immiscibility of the polyester and polyamide resins chosen can create difficulty in forming conjugate fibers. Blends comprising immiscible polymers have two or more phases, and such blends may be incompatible. Incompatible blends of immiscible polymers can suffer from phase separation and fibers formed from such blends may fibrillate, which would not provide the durability necessary for commercial use. Additionally, polymers from the same class are frequently immiscible and form multiphasic compositions. Therefore, polymer miscibility is difficult to predict, even within the same class of polymers.

For this reason, previous attempts at using a combination of polyester and polyamides in carpet have required the use of a compatibilizing agent or an additional component. U.S. Pat. No. 6,780,941 to Studholme, herein incorporated by reference, teaches blending of thermoplastic polyester with fiber-forming polyamide in the production of melt-spun fibers, wherein the polyamide component forms the major phase. In order to form the fiber, the use of at least 1% by weight or more of a metal sulfonated poly(butylene terephthalate) as a compatibilizing additive is required.

PCT Publication No. 2013133640, herein incorporated by reference, teach that due to a lack of compatibility, it is difficult to melt extrude fibers from polyester and polyamides. To solve this problem, the addition of a compatibilizing agent, such as an epoxy resin is required to form a usable alloy fiber. In addition, this publication only teaches fibers with a polyamide major phase and an effective compatibilizer loading at 2% by weight or more.

U.S. Pat. No. 6,090,494 teaches fibers that contain both polyamide and polyester filaments. However, to be effective and avoid fibrillation, the amount of polyester is limited and only fibers containing predominantly polyamide filaments are disclosed.

European Patent Application No. 2,748,259A1 teaches a composition comprising both polyamide and polyester components, wherein the polyester component is preferred at 40% or less by weight, and without requiring a compatibilizer. However, the disclosure does not teach a composition that can be effectively melt spun into a fiber.

SUMMARY OF THE INVENTION

Therefore, there is a need in the art for fibers for use in carpets with the inherent stain resistance and the low cost of polyester and improved durability and soiling properties. There is also a need in the art for a method to form fibers for use in carpets with desired durability, wherein the fibers contain polyester and polyamide resins and require a reduced amount of a compatibilizing agent or an additional polymer.

In one aspect of the present invention, a multipolymer fiber is disclosed comprising a polyester phase formed from at least one polyester resin, present at between about 50 to about 95 percent by weight and a polyamide phase formed from at least one polyamide resin, present at between about 5 to about 50 percent by weight, wherein the polyamide phase is distinct from the polyester phase and comprises a plurality of polyamide fibrils dispersed in the polyester phase, and wherein the polyamide fibrils are separately distinguishable from each other. Yarns, textiles and carpets formed from this composition are also disclosed. In one nonlimiting embodiment, the polyamide phase is present at between about 10 to about 25 percent by weight of the multipolymer fiber. In yet another nonlimiting embodiment, the multipolymer fiber further comprises about 1% or less by weight of a compatibilizing agent.

In one nonlimiting embodiment, the polyamide fibrils have an average diameter size in the range from about 100 nm to about 400 nm.

In one nonlimiting embodiment, a majority of the polyamide fibrils are continuous fibrils that span the length of the multipolymer fiber. In another nonlimiting embodiment, a majority of the polyamide fibrils have an average length that is at least 10 times the average diameter of the polyamide fibrils. In yet another nonlimiting embodiment of the present invention, a majority of the polyamide fibrils have an average length that is at least about 10,000 nm.

In another nonlimiting embodiment, the multipolymer fiber is a bulk continuous filament (BCF) fiber.

In another nonlimiting embodiment, the at least one polyester resin is selected from the group consisting of polyethylene terephthalate, polytrimethylene terephthalate, polybutylene terephthalate, polyethylene naphthalate and blends or copolymers thereof. In one nonlimiting embodiment, the polyester resin is polyethylene terephthalate. In another nonlimiting embodiment, the polyester phase is formed from at least one polyester resin with isophthalic acid content of about 0.01 to about 8 percent by weight.

In another nonlimiting embodiment, the at least one polyamide resin is selected from the group consisting of nylon 6,6, nylon 6, nylon 7, nylon 11, nylon 12, nylon 6,10, nylon 6,12, nylon 6,12, nylon DT, nylon 6T, nylon 6I and blends or copolymers thereof. In one nonlimiting embodiment, the polyamide resin is nylon 6,6. In another nonlimiting embodiment, the polyamide phase is formed from at least one polyamide resin with sulfonated isophthalic acid content of about 4.01 to about 8 percent by weight.

In another nonlimiting embodiment, the polyamide phase is formed from at least one polyamide resin with an RV in the range of about 20 to about 60, and amine end groups in the range of about 20 to about 40 meq/kg. In one nonlimiting embodiment, the polyamide phase is formed from at least one polyamide resin with an amine end group content of about 40 meq/kg or less.

In another nonlimiting embodiment, there is sufficient interfacial bonding between the polyester phase and the polyamide phase to maintain fibril stability of the plurality of polyamide fibrils dispersed within the polyester phase. In one nonlimiting embodiment, more than about 25% of the polyamide fibrils will break on the same cross-sectional plane as the polyester phase when the multipolymer fiber is subject to a freeze fracture test. In yet another nonlimiting embodiment, more than about 50% the polyamide fibrils will break on the same cross-sectional plane as the polyester phase when the multipolymer fiber is subject to a freeze fracture test.

In another nonlimiting embodiment, a carpet formed from the multipolymer fiber is disclosed. In a nonlimiting embodiment, a carpet with a vetterman-5K rating is 3 or greater when evaluated according to ASTM D5417 is disclosed. In yet another nonlimiting embodiment, a carpet with a pile compression of less than about 10% is disclosed.

In another aspect of the present invention, a multipolymer fiber is disclosed comprising a polyester phase formed from at least one polyester resin, present at between about 50 to about 95 percent by weight and a polyamide phase formed from at least one polyamide resin, present at between about 5 to about 50 percent by weight, wherein the polyamide phase is distinct from the polyester phase and comprises a plurality of polyamide fibrils dispersed in the polyester phase, and wherein the polyamide fibrils are separately distinguishable from each other, and wherein the multipolymer fiber excludes a compatibilizing agent. Yarns, textiles and carpets formed from this composition are also disclosed. In one nonlimiting embodiment, the polyamide phase is present at between about 10 to about 25 percent by weight of the multipolymer fiber.

In another aspect of the present invention a method for forming a multipolymer fiber is disclosed. In one nonlimiting embodiment, the method comprises combining at least one polyester resin and at least one polyamide resin to form a polymer melt, wherein the at least one polyester resin is present from about 50 to about 95 percent by weight of the polymer melt and the at least one polyamide resin is present from about 5 to about 50 percent by weight of the polymer melt and forming a multipolymer fiber from the polymer melt comprising a polyester phase and a polyamide phase, wherein the polyamide phase is distinct from the polyester phase and comprises a plurality of polyamide fibrils dispersed in the polyester phase, and wherein the polyamide fibrils are separately distinguishable from each other.

In one nonlimiting embodiment of the method, the at least one polyester resin has a moisture content below about 100 ppm and the at least one polyamide resin has a moisture content below 500 ppm. In another nonlimiting embodiment, the polymer melt is dried to a moisture content below 100 ppm prior to forming the multipolymer fiber.

In one nonlimiting embodiment of the method further comprises forming the multipolymer fiber at a spin draw ratio of about 90 or lower. In another nonlimiting embodiment, forming the multipolymer fiber further comprises advancing the polymer melt through a spinneret capillary at an exit velocity of about 30 feet per minute or greater. In yet another nonlimiting embodiment, forming the multipolymer fiber further comprises advancing the polymer melt through a spinneret capillary at an exit velocity of about 40 feet per minute or greater.

In another nonlimiting embodiment of the method, the polyamide fibrils have an average diameter size in the range from about 100 nm to about 400 nm.

In one nonlimiting embodiment of the method, a majority of the polyamide fibrils are continuous fibrils that span the length of the multipolymer fiber. In another nonlimiting embodiment of the method, a majority of the polyamide fibrils have an average length that is at least 10 times the average diameter of the polyamide fibrils. In yet another nonlimiting embodiment of the method, a majority of the polyamide fibrils have an average length that is at least about 10,000 nm.

In another nonlimiting embodiment, a carpet formed from the multipolymer fiber formed the method is disclosed. In a nonlimiting embodiment, a carpet with a vetterman-5K rating is 3 or greater when measured using ASTM D5417 is disclosed. In yet another nonlimiting embodiment, a carpet with a pile compression of less than about 10% is disclosed.

In another aspect of the present invention a method for forming a multipolymer fiber is disclosed. In one nonlimiting embodiment, the method comprises combining at least one polyester resin and at least one polyamide resin to form a polymer melt, wherein the at least one polyester resin is present from about 50 to about 99 percent by weight of the polymer melt and the at least one polyamide resin is present from about 1 to about 50 percent by weight of the polymer melt, wherein the polymer melt excludes a compatibilizing agent and forming a multipolymer fiber from the polymer melt comprising a polyester phase and a polyamide phase, wherein the polyamide phase is distinct from the polyester phase and comprises a plurality of polyamide fibrils dispersed in the polyester phase, and wherein the polyamide fibrils are separately distinguishable from each other.

DETAILED DESCRIPTION OF THE INVENTION

Figure 1:
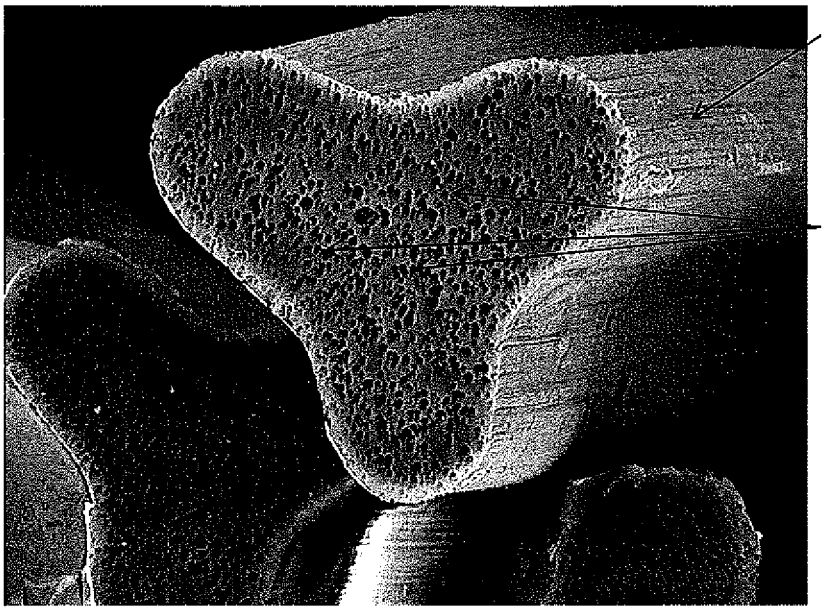
FIG. 1 depicts a cross-sectional image of a fiber of the present invention.

The present invention relates to a multipolymer fiber, wherein the multipolymer fiber comprises a polyester phase and polyamide phase. The resultant multipolymer fiber exhibits improved durability and soiling when compared to polyester fibers. Also disclosed herein are yarns, textiles and carpets formed from the multipolymer fibers.

All patents, patent applications, test procedures, priority documents, articles, publications, manuals, and other documents cited herein are fully incorporated by reference to the extent such disclosure is not inconsistent with this invention and for all jurisdictions in which such incorporation is permitted.

One aspect of the present invention comprises a multipolymer fiber comprising a polyester phase formed from at least one polyester resin, present at between about 50 to about 95 percent by weight and a polyamide phase formed from at least one polyamide resin, present at between about 5 to about 50 percent by weight, wherein the polyamide phase is distinct from the polyester phase and comprises a plurality of polyamide fibrils dispersed in the polyester phase, and wherein the polyamide fibrils are separately distinguishable from each other. In another nonlimiting embodiment, the polyamide phase is present at between about 10 to about 25 percent by weight of the multipolymer fiber.

Suitable polyesters include any fiber forming polyesters known in the art. The at least one polyester resin may be selected from the group consisting of polyethylene terephthalate, polytrimethylene terephthalate, polybutylene terephthalate, polyethylene naphthalate and blends or copolymers thereof. In one nonlimiting embodiment, the at least one polyester is polyethylene terephthalate.

Suitable polyamides include any fiber forming polyamides known in the art. The at least one polyamide resin may be selected from the group consisting of nylon 6,6, nylon 6, nylon 7, nylon 11, nylon 12, nylon 6,10, nylon 6,12, nylon 6,12, nylon DT, nylon 6T, nylon 6I and blends or copolymers thereof. In one embodiment the at least one polyamide is present at between about 5 to about 25 percent by weight. In one nonlimiting embodiment the at least one polyamide is nylon 6,6.

In nonlimiting embodiments, the multipolymer fibers may have any suitable cross section, including any suitable cross section used in the art for carpet yarns. This includes circular, multi-lobal, rectangular, square or oval cross sections. In one nonlimiting embodiment, the multipolymer fibers formed may have a tri-lobal cross section. The multipolymer fiber cross section may also include a specified number of regularly or irregularly-shaped voids for the purpose of producing filaments having voids that span the length of filament. For example, the multipolymer fiber cross section may include three, or four, or six voids.

In nonlimiting embodiments, the at least one polyamide may further comprise a cationic dye additive. The use of cationic dye additives in polyamides has been discussed in U.S. Pat. No. 5,108,684 to Anton, herein incorporated by reference. Suitable cationic dye additives which may be used to produce the stain-resistant yarns of this invention include those aromatic sulfonates and their alkali metal salts which are capable of copolymerizing with polyamide-forming raw materials. Examples of such compounds include sulfonated dicarboxylic acids and the diesters of such diacids, with the most preferred additive being the alkali metal salts of 5-sulfoisophthalic acid. In an embodiment, the at least one polyamide resin comprises a sulfonated isophthalic acid content of about 0.01 to about 8 percent by weight. In another embodiment, the at least one polyamide resin comprises a sulfonated isophthalic acid content of about 1 to about 4 percent by weight.

In nonlimiting embodiments, the at least one polyester resin may also contain an isophthalic acid. In one embodiment, the at least one polyester resin comprises an isophthalic acid content of about 0.01 to about 8 percent by weight. In another embodiment, the at least one polyester resin comprises an isophthalic acid content of about 1 to about 4 percent by weight.

In nonlimiting embodiments, the multipolymer fibers may also comprise a component selected from the group consisting of colorants, delustrants, catalysts, spin assists, dye level modifiers, anti-microbial agents, stabilizers, flame-retardants, anti-oxidants, acidic moieties conducive to cationic dyeing, and combinations thereof. In one embodiment, the colorant is titanium dioxide.

The applicants have surprisingly achieved the result of forming multipolymer fibers wherein there are two distinct phases, wherein the polyamide phase is comprised of separately distinguishable polyamide fibrils. In aspects of the present invention, there is sufficient interfacial bonding between the polyamide fibrils and the polyester phase to maintain fibril stability and the distinct phases. Interfacial bonding refers to the adhesion between the polyamide fibrils and the polyester phase. Without being bound by any particular theory, it is believed that strong interfacial bonding between the polyamide and polyester phase allows for strong load transfer between the polyamide fibrils and the polyester phase. This results in properties of the multipolymer fibers being improved over those of typical polyester fibers. Furthermore, it is believed that the polyamide fibrils provide improved resiliency to the multipolymer fibers over that of typical polyester fibers.

In one nonlimiting embodiment, FIG. 1 shows a multipolymer fiber 10. As shown in the FIG. 1, the polyamide fibrils 30 are separately distinguishable and formed in the polyester phase 20 of the multipolymer fiber 10. In nonlimiting embodiments, polyamide fibrils have an average diameter size in the range from about 100 nm to about 400 nm. In another nonlimiting embodiment, the polyamide fibrils have an average diameter size in the range from about 200 nm to about 300 nm. In nonlimiting embodiments, the polyamide fibrils may have various cross sections. In one nonlimiting embodiment, the polyamide fibrils have circular cross sections.

Figure 2:
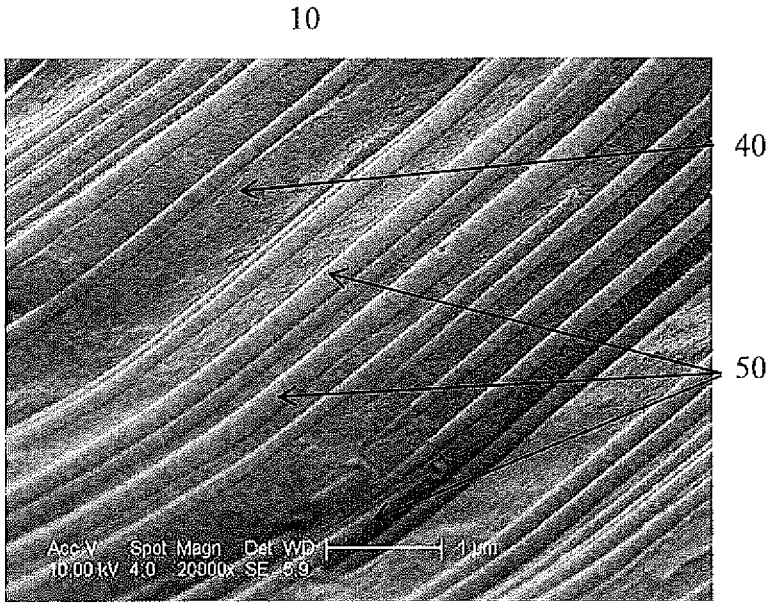
FIG. 2 depicts a cross-sectional image of a fiber of the present invention.

In one nonlimiting embodiment, the majority of polyamide fibrils are substantially continuous and orientated in the longitudinal axial direction of the multipolymer fiber. FIG. 2 illustrates a nonlimiting embodiment of the present invention wherein the polyamide fibrils 50 are substantially continuous within the polyester phase 40 of the multipolymer fiber 10. In one nonlimiting embodiment, a majority of the polyamide fibrils are continuous fibrils that span the length of the multipolymer fiber. In one nonlimiting embodiment, a majority of the polyamide fibrils have an average length that is at least 10 times the average diameter of the polyamide fibrils. In one nonlimiting embodiment, a majority of the polyamide fibrils have an average length that is at least about 10,000 nm.

Figure 3A:
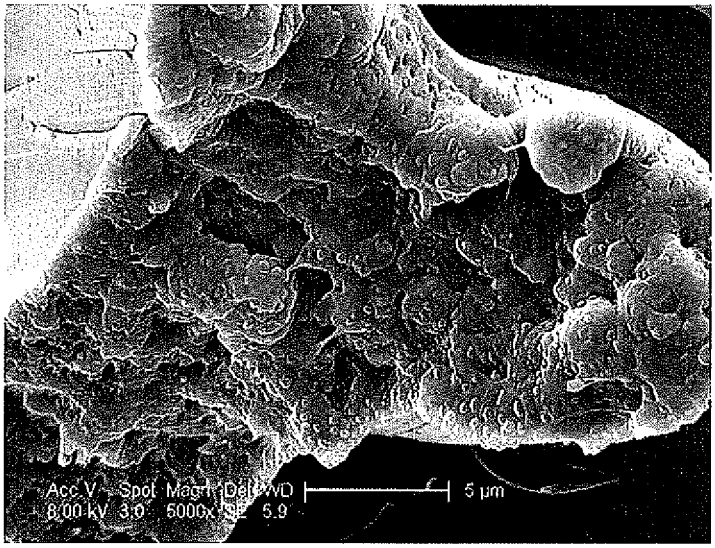
FIGS. 3*a* and 3*b* depict magnified cross-sectional images of a fiber of the present invention after a freeze fracture test.
Figure 3B:
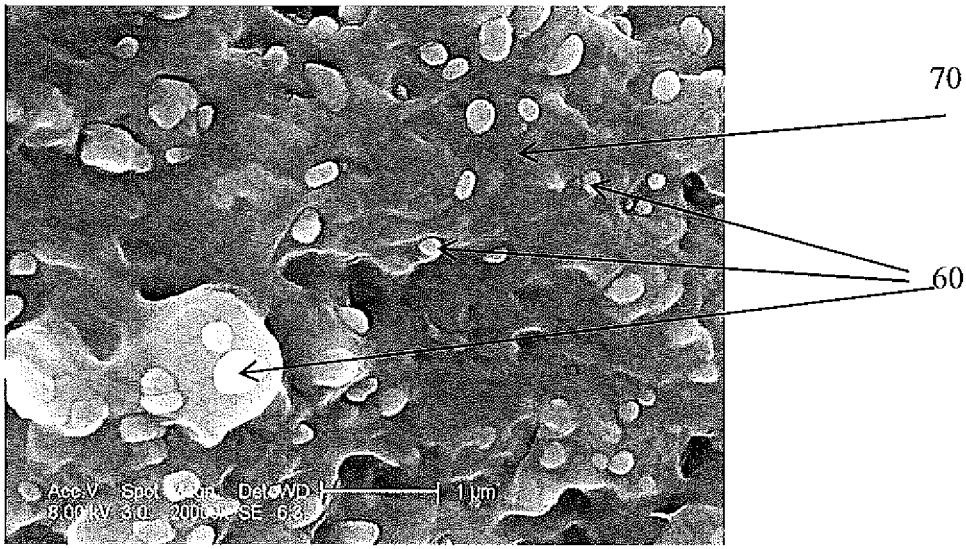
Figure 4:
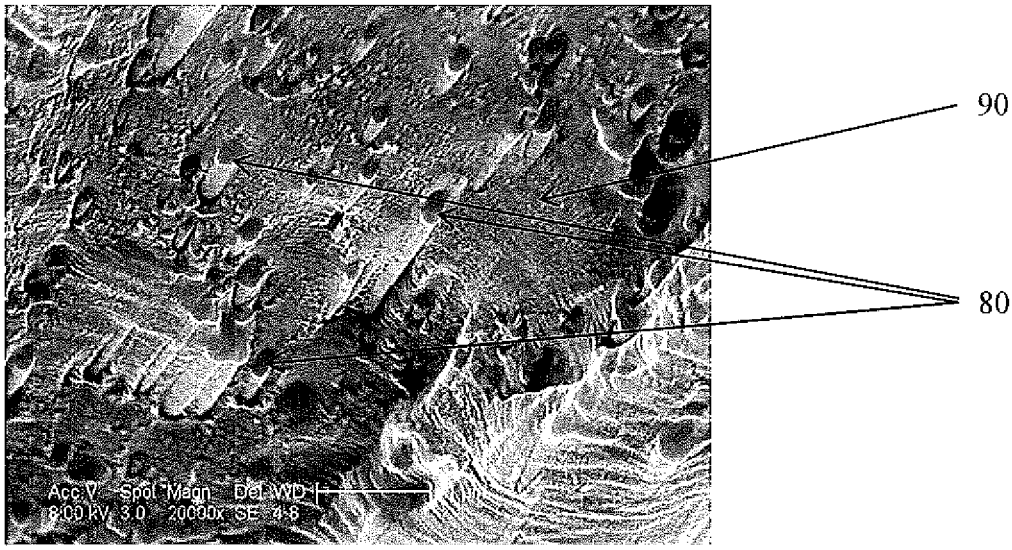
FIG. 4 depicts a cross-sectional image of a comparative multipolymer fiber after a freeze fracture test.

In nonlimiting embodiments of the multipolymer fiber, there is sufficient interfacial bonding between the polyester phase and the polyamide phase to maintain fibril stability of the plurality of polyamide fibrils dispersed within the polyester phase. FIGS. 3 and 4 depict cross sections of multipolymer fibers that have been subjected to a freeze fracture test, as defined herein. FIG. 4 illustrates a multipolymer fiber wherein the polyester phase is 90% by weight and the polyamide phase is 10% by weight. The polyamide has an amine end content of 126 meq/kg. As can be seen, the majority of polyamide fibrils 80 have been pulled out of the polyester phase 90. Without being bound by any particular theory, it is believed this a result of weak interfacial bonding between the polyester phase and the polyamide phase. FIGS. 3*a* and 3*b* depict a nonlimiting embodiment of the present invention. As can be seen in FIG. 3*b* the polyamide fibrils are separately distinguishable and there are distinct polyamide and polyester phases. Without being bound by any particular theory, this a result of sufficiently strong interfacial bonding between the polyester phase and the polyamide phase. As can be seen in Examples, 1-4, the carpets formed from these multipolymer fibers exhibit improved durability as a result of the fibril stability of the polyamide fibrils dispersed in the polyester phase.

In nonlimiting embodiments, more than about 25% of the polyamide fibrils will break on the same cross-sectional plane as the polyester phase when the multipolymer fiber is subject to the freeze fracture test, as defined herein. In nonlimiting embodiments, more than about 50% the polyamide fibrils will break on the same cross-sectional plane as the polyester phase when the multipolymer fiber is subject to the freeze fracture test, as defined herein.

The applicants unexpectedly found that when the polyamide phase was comprised of polyamide resins with an amine end content of 40 with meq/kg or less, multipolymer fibers of the present invention could be formed without the need of a compatibilizing agent. To those skilled in the art, it is well known that typical polyamide resins have an amine end content in range of between about 45 to about 55 meq/kg. Therefore, through undue experimentation, the applicants discovered that the use of a polyamide phase with low amine end content allowed for a multipolymer fiber with the necessary fibril stability to maintain distinct polyamide and polyester phases.

In one nonlimiting embodiment, the at least one polyamide resin may have a relative viscosity (RV) in the range of about 20 to about 60, and amine end groups in the range of about 20 to about 40 meq/kg. In another nonlimiting embodiment, the at least one polyamide resin may have a relative viscosity (RV) in the range of about 20 to about 30, and amine end groups in the range of about 30 to about 40 meg/kg.

It has long been thought in the art that the relative immiscibility of polyamides and polyesters made it difficult to form fibers composed with blends of the two resins. U.S. Pat. No. 6,780,941 to Studholme teaches that a compatibilizing agent is necessary to form a useful fiber comprising a polyamide and polyester. Likewise, WO2013133640 to Lim found an epoxy resin was required to achieve the compatibility necessary to form a hybrid fiber including polyamide and polyester. Attempts to form fibers utilizing other polymers have also required the use of a compatibilizing agent. For example U.S. Pat. No. 6,132,839 to Reader, and WO200302956 A1 to Bertamini, herein incorporated by reference, teach the use of maleated polymers as being necessary for forming alloy fibers of a polypropylene and polyamide. Such maleated polymers act to compatibilize what are otherwise immiscible or phase separated polymer types. As exemplified by Lim, use of a chain terminating epoxy functionality in a resin has also been used to achieve the phase compatibilizing benefit of two immiscible polymer types. Even with the use of a compatibilizing agent, none of these references teach a fiber with polyamide fibrils forming distinct phases within a polyester phase.

Therefore, another aspect of the present invention discloses a multipolymer fiber comprising a polyester phase formed from at least one polyester resin, present at between about 50 to about 95 percent by weight and a polyamide phase formed from at least one polyamide resin, present at between about 5 to about 50 percent by weight, wherein the polyamide phase is distinct from the polyester phase and comprises a plurality of polyamide fibrils dispersed in the polyester phase, and wherein the polyamide fibrils are separately distinguishable from each other, and wherein the multipolymer fiber excludes a compatibilizing agent.

In nonlimiting embodiments of the present invention, a compatibilizer may be used when the amine content of the polyamide phase is greater than 40 meq/kg. Example 4 discloses a multipolymer fiber wherein a compatibilizing agent is used and the polyamide phase has an amine end content of 57 meq/kg. In nonlimiting embodiments, the multipolymer fiber further comprises about 1% or less by weight of a compatibilizing agent. In nonlimiting embodiments, the compatibilizer may be any known compatibilizer in the art for use with polyamides and polyesters. In one nonlimiting embodiment, the compatibilizer may be chosen from a maleic anhydride containing compatibilizer and carbonylbiscaprolactam. In one nonlimiting embodiment, the compatibilizer is styrene maleic anhydride copolymer (SMA).

In nonlimiting embodiments, the multipolymer fiber may be used to form various fiber types known in the art. In nonlimiting embodiments, the multipolymer fiber may be used to form staple fiber or fibers useful in airbags, textiles or apparel. In nonlimiting embodiments, the multipolymer fiber may be used to form bulk continuous filament (BCF) fiber. In nonlimiting embodiments, yarns may be formed from the multipolymer fiber. In nonlimiting embodiments, textiles may be formed from the multipolymer fibers. In one nonlimiting embodiment, carpets may be formed from the fibers. As shown in Examples 1-4 and Tables 1-4 below, the carpet formed from the multipolymer fiber has been found to have a Carpet Durability rating of 3 or greater, wherein the Carpet Durability rating is evaluated according to the method described in ASTM D5417. In addition, the carpet formed from the fiber was shown to have a pile compression of less than 10% and a Delta E of from about 11 to about 15, wherein Delta E is measured using AATCC 123-2000. As can be seen in Table 1, carpets formed from nonlimiting embodiments have significant Delta E properties after a second soiling.

In another aspect, a method of making the multipolymer fibers of the present disclosure is disclosed, wherein the method comprises combining at least one polyester resin and at least one polyamide resin to form a polymer melt, wherein the at least one polyester resin is present from about 50 to about 95 percent by weight of the polymer melt and the at least one polyamide resin is present from about 5 to about 50 percent by weight of the polymer melt and forming a multipolymer fiber from the polymer melt comprising a polyester phase and a polyamide phase, wherein the polyamide phase is distinct from the polyester phase and comprises a plurality of polyamide fibrils dispersed in the polyester phase, and wherein the polyamide fibrils are separately distinguishable from each other. In another nonlimiting embodiment, the polyamide phase is present at between about 10 to about 25 percent by weight of the multipolymer fiber.

Suitable methods of combining the at least one polyester resin and at least one polyamide resin to form a polymer melt include those well known in the art. In one nonlimiting embodiment, the polymer melt is formed in an extruder. Suitable extruders include those known in the art for use in polymer melt spinning. Suitable extruders include single screw, double screw and multiple screw extruders. Suitable extruders may also be vented.

In a nonlimiting embodiment the at least one polyamide resin has a moisture content below about 100 ppm and the at least one polyamide resin has a moisture content below about 500 ppm. In another nonlimiting embodiment, the at least one polyamide resin may be dried to a moisture level below about 50 ppm. In another nonlimiting embodiment, the at least one polyester resin and at least one polyamide resin may be dried separately from each other prior to combination in the polymer melt. In another nonlimiting embodiment, the at least one polyester resin and at least one polyamide resin are dried separately, and melted separately prior to combination in the polymer melt. In another nonlimiting embodiment, the at least one polyester resin and at least one polyamide resin are dried separately prior to combination in the polymer melt, where one or both are dried in a low oxygen atmosphere. The drying may be performed in any suitable manner known in the art, including in a batch or continuous process. The use of heat may also be employed in the drying the process. In one nonlimiting embodiment, the polymer melt may be dried in the presence of nitrogen. In one nonlimiting embodiment, the polymer melt may be dried in the presence of nitrogen wherein the oxygen content is less than about 1 percent.

In a nonlimiting embodiment, the spin draw ratio is controlled when forming the multipolymer fiber. In one nonlimiting embodiment, during the spinning process, the multipolymer fiber may be extruded through a spinneret capillary and may be drawn over multiple feed rolls. The first feed roll is commonly referred to as the first take up roll. The spin draw ratio, as used herein, is the ratio of the velocity of the multipolymer fiber over the first take up roll to the exit velocity of the multipolymer fiber through the spinneret capillary. In one nonlimiting embodiment, a spin draw ratio of about 90 or lower is maintained when forming the multipolymer fiber. It is well known in the art that polyester fibers are typically spun with an exit velocity through a spinneret capillary of less than about 30 feet per minute. In one nonlimiting embodiment, the applicants surprisingly found that increasing the exit velocity of the multipolymer through the spinneret capillary allowed for the formation of the multipolymer fibers wherein the polyamide phase is distinct from the polyester phase and comprises a plurality of polyamide fibrils dispersed in the polyester phase, and wherein the polyamide fibrils are separately distinguishable from each other. In one nonlimiting embodiment, forming the multipolymer further comprises advancing the polymer melt through a spinneret capillary at an exit velocity of about 30 feet per minute or greater. In another nonlimiting embodiment, forming the multipolymer further comprises advancing the polymer melt through a spinneret capillary at an exit velocity of about 40 feet per minute or greater.

In nonlimiting embodiments, the method of making the multipolymer fiber further comprises drawing the fibers formed to form a yarn. The yarn may be drawn at a draw ratio of about 2 to about 5. In one nonlimiting embodiment, the yarn formed has nominal denier range from about 500 to about 3600 and has a nominal denier per filament range from about 1 to about 25. In a nonlimiting embodiment, the yarn may have a nominal denier per filament range from about 3 to about 18.

Suitable polyesters include any fiber forming polyesters known in the art. The at least one polyester resin may be selected from the group consisting of polyethylene terephthalate, polytrimethylene terephthalate, polybutylene terephthalate, polyethylene naphthalate and blends or copolymers thereof. In one nonlimiting embodiment, the at least one polyester is polyethylene terephthalate.

Suitable polyamides include any fiber forming polyamides known in the art. The at least one polyamide resin may be selected from the group consisting of nylon 6,6, nylon 6, nylon 7, nylon 11, nylon 12, nylon 6,10, nylon 6,12, nylon 6,12, nylon DT, nylon 6T, nylon 6I and blends or copolymers thereof. In one embodiment the at least one polyamide is present at between about 5 to about 25 percent by weight. In one nonlimiting embodiment the at least one polyamide is nylon 6,6.

In nonlimiting embodiments, the multipolymer fibers may have any suitable cross section, including any suitable cross section used in the art for carpet yarns. This includes circular, multi-lobal, rectangular, square or oval cross sections. In one nonlimiting embodiment, the multipolymer fibers formed may have a tri-lobal cross section. The multipolymer fiber cross section may also include a specified number of regularly or irregularly-shaped voids for the purpose of producing filaments having voids that span the length of filament. For example, the multipolymer fiber cross section may include three, or four, or six voids.

In a nonlimiting embodiment, the at least one polyamide resin comprises a sulfonated isophthalic acid content of about 0.01 to about 8 percent by weight. In another embodiment, the at least one polyamide resin comprises a sulfonated isophthalic acid content of about 1 to about 4 percent by weight.

In nonlimiting embodiments, the at least one polyester resin may contain an isophthalic acid. In an embodiment, the at least one polyester resin comprises an isophthalic acid content of about 0.01 to about 8 percent by weight. In another embodiment, the at least one polyester resin comprises an isophthalic acid content of about 1 to about 4 percent by weight.

In nonlimiting embodiments, the multipolymer fibers also comprise a component selected from the group consisting of colorants, delustrants, catalysts, spin assists, dye level modifiers, anti-microbial agents, stabilizers, flame-retardants, anti-oxidants, acidic moieties conducive to cationic dyeing, and combinations thereof. In one embodiment, the colorant is titanium dioxide.

In nonlimiting embodiments, polyamide fibrils have an average diameter size in the range from about 100 nm to about 400 nm. In another nonlimiting embodiment, the polyamide fibrils have an average diameter size in the range from about 200 nm to about 300 nm. In nonlimiting embodiments, the polyamide fibrils may have various cross sections. In one nonlimiting embodiment, the polyamide fibrils have circular cross sections.

In one nonlimiting embodiment, the majority of polyamide fibrils are substantially continuous and orientated in the longitudinal axial direction of the multipolymer fiber. In one nonlimiting embodiment, a majority of the polyamide fibrils are continuous fibrils that span the length of the multipolymer fiber. In one nonlimiting embodiment, a majority of the polyamide fibrils have an average length that is at least 10 times the average diameter of the polyamide fibrils. In one nonlimiting embodiment, a majority of the polyamide fibrils have an average length that is at least about 10,000 nm.

In nonlimiting embodiments of the multipolymer fiber, there is sufficient interfacial bonding between the polyester phase and the polyamide phase to maintain fibril stability of the plurality of polyamide fibrils dispersed within the polyester phase. In nonlimiting embodiments, more than about 25% of the polyamide fibrils will break on the same cross-sectional plane as the polyester phase when the multipolymer fiber is subject to the freeze fracture test, as defined herein. In nonlimiting embodiments, more than about 50% the polyamide fibrils will break on the same cross-sectional plane as the polyester phase when the multipolymer fiber is subject to the freeze fracture test, as defined herein.

In one nonlimiting embodiment, the at least one polyamide resin may have a relative viscosity (RV) in the range of about 20 to about 60, and amine end groups in the range of about 20 to about 40 meq/kg. In another nonlimiting embodiment, the at least one polyamide resin may have a relative viscosity (RV) in the range of about 20 to about 30, and amine end groups in the range of about 30 to about 40 meq/kg. In another nonlimiting embodiment the at least one polyamide resin has an amine end content of about 40 meq/kg or less.

In nonlimiting embodiments of the method, a compatibilizer may be used when the amine content of the polyamide phase is greater than about 40 meq/kg. In nonlimiting embodiments, the multipolymer fiber further comprises about 1% or less by weight of a compatibilizing agent. In nonlimiting embodiments, the compatibilizer may be any known compatibilizer in the art for use with polyamides and polyesters. In one nonlimiting embodiment, the compatibilizer may be chosen from a maleic anhydride containing compatibilizer and carbonylbiscaprolactam. In one nonlimiting embodiment, the compatibilizer is styrene maleic anhydride copolymer (SMA).

In nonlimiting embodiments, the multipolymer fiber may be used to form various fiber types known in the art. In nonlimiting embodiments, the multipolymer fiber may be used to form staple fiber or fibers useful in airbags, textiles or apparel. In nonlimiting embodiments, the multipolymer fiber may be used to form bulk continuous filament (BCE) fiber. In nonlimiting embodiments, yarns may be formed from the multipolymer fiber. In nonlimiting embodiments, textiles may be formed from the multipolymer fibers. In one nonlimiting embodiment, carpets may be formed from the fibers.

In another aspect, a method of making the multipolymer fibers of the present disclosure is disclosed, wherein the method comprises combining at least one polyester resin and at least one polyamide resin to form a polymer melt, wherein the at least one polyester resin is present from about 50 to about 99 percent by weight of the polymer melt and the at least one polyamide resin is present from about 1 to about 50 percent by weight of the polymer melt, wherein the polymer melt excludes a compatibilizing agent and forming a multipolymer fiber from the polymer melt comprising a polyester phase and a polyamide phase, wherein the polyamide phase is distinct from the polyester phase and comprises a plurality of polyamide fibrils dispersed in the polyester phase, and wherein the polyamide fibrils are separately distinguishable from each other.

Definitions

AEG—amine end groups, which are commonly understood in the trade as a control on acid dyeability, and as can be determined by dissolution of nylon polymer in 68/32 wt % phenol/methanol solvent and potentiometric titration with 0.05 m hydrochloric acid, using commercially available equipment. The results are corrected for moisture and titanium dioxide content and expressed in numerical value in units of meq/kg.

fpm—feet per minute.

IV—intrinsic viscosity, as is commonly understood in the trade and as can be calculated by use of ASTM D4603.

meq/kq—milliequivilants of amine per kilogram of polymer.

ppm—parts per million.

RV—relative viscosity, as is commonly understood in the trade and as can be determined by ASTM D789.

SEM—Scanning Electron Microscopy

SIPA—sulfonated isophthalic acid.

tpi—turns per inch.

ypm—yards per minute.

Test Methods

Carpet Durability Test

Carpet durability was evaluated based on procedures described in the Vetterman Drum Texture Retention Test (ASTM D5417), and Taber Abrasion Test (ASTM F510).

Carpet Soiling Test

The Soiling performance of the carpet was measured by Carpet Soiling: Accelerated Soiling Method (AATCC Test Method 123-2000).

Pile Compression Test

Pile compression was determined by measuring pile thickness in the control area and the test area of carpet sample after running 5,000 cycles in the Vetterman Drum. Pile thickness was measured using WRONZ Pile Thickness Gauge. Pile compression was expressed as % change in thickness from the control area, to the test area.

Freeze Fracture Method

The interfacial bonding between the polyamide fibrils and the polyester phase of the multipolymer fiber was analyzed by SEM by preparing the fiber specimens according to a freeze fracture method. Briefly, a short (2-6 inches) length of fiber was encapsulated in epoxy, submerged in liquid nitrogen and fractured at liquid nitrogen temperatures. SEM analysis of a cross section of the fractured fiber surface was then performed using standard preparation and imaging techniques.

Spinning Process

A standard fiber spinning operation was used for making bulked continuous filament (BCF) yarn for flooring end-use. All yarn samples produced were nominally 1000 denier, 184 filament count, with a trilobal cross-section. The control yarn sample was spun from 100% PET. Experimental yarns were made from salt-and-pepper blend mixes of PET and N66. In each instance, the blended polymer mix was dried to below 50 ppm $H_2O$ content for the polyester, and below 300 ppm $H_2O$ content for the polyamide. The mix then was fed to an extruder. Additives including titanium dioxide and other pigments were used to get the desired antique white color. The polymer temperature before the spinning pack was controlled at about 290° C. The exit velocity of the polymer melt from the spinneret capillary, defined as the volume of polymer melt per unit time, divided by spinneret capillary cross-section area, was 60.5 feet per minute (18.4 meters per minute). The spinning throughput was thirty eight pounds (38 lbs; 17.0 kg) per hour per threadline. The polymer melt was extruded through a trilobal spinneret to produce filaments.

The molten fibers were then rapidly quenched in a chimney, where cooling air at about fifteen degrees Centigrade (~15° C.) was blown past the filaments through the quench zone. The filaments were then coated with a lubricant at 1.1% finish on yarn (FOY) for drawing and crimping. The coated yarns were drawn at a draw ratio of about three to four, using a set of heated draw pins. The draw pin temperature was 150-180° C. The filaments were then forwarded into a dual-impingement bulking jet (200° C. hot air) similar to that described in U.S. Pat. No. 3,525,134 to form two (2) one thousand denier (1000 denier; 1111 decitex), and 5.4 denier per filament (dpf) yarns (6.0 decitex per filament). Each yarn sample was produced at winding speed of about 2,500 ypm.

The spun, drawn, and crimped bulked continuous filament (BCF) yarns were cable-twisted to 5.75 tpi on a cable twister and heat-set at a temperature of 290° F. (143° C.) on a Superba® continuous carpet yarn heat-setting machine.

The yarns were then tufted into thirty ounce per square yard (30 oz/sq. yd; having 0.5 inch (1.3 cm) pile height cut pile carpets on a ⅛ inch gauge (0.318 cm) tufting machine.

EXAMPLES

The following Examples demonstrate the nonlimiting embodiments of the present invention and its capability for use. The invention is capable of other and different embodiments, and its several details are capable of modifications in various apparent respects, without departing from the scope and spirit of the present invention. Accordingly, the Examples are to be regarded as illustrative in nature and nonlimiting.

Example 1

In an example of the invention, yarn was spun as described above. PET (IV=0.83, 2% IPA, Auriga Polymers, Inc., Spartanburg, S.C., USA) was used as the base polymer, using N66 made by INVISTA (RV~25, AEG~36 mpmg, SIPA~3 mol %).

The test yarns were then tufted into thirty ounce per square yard (30 oz/sq. yd; having 0.5 inch (1.3 cm) pile height cut pile carpets on a ⅛ inch gauge (0.318 cm) tufting machine.

Carpets made from items A, B, and C were evaluated using the abovementioned test methods for durability and soiling. Durability and soiling results are shown in Table 1.

TABLE 1

Durability and Soiling Test Results

| Yarn Item ID | wt % PET | wt. % N66 | Carpet Vetterman 5k rating | Carpet Pile compression, % | Carpet ΔE after first soiling | Carpet ΔE after hot water extraction | Carpet ΔE after second soiling |
|---|---|---|---|---|---|---|---|
| A | 100 | 0 | 2 | 20.7 | 14.71 | 7.72 | 17.73 |
| B | 90 | 10 | 3.8 | 7.5 | 14.52 | 2.77 | 13.22 |
| C | 80 | 20 | 4 | 3.5 | 11.92 | 4.00 | 11.96 |

Example 2

For items D, E, F and G, yarn was spun as described by the Spinning Process. The PET resin (IV=0.83, 2% IPA) was from Auriga Polymers, Inc. (Spartanburg, S.C., USA). Carpet item D was made using 100% PET. Carpet item E was made using 85% PET, and 15% N66 (RV=25, AEG=38, 2% SIPA) made by INVISTA. Carpet item F was made using 85% PET, and 15% N66 (RV=45, AEG=57) made by INVISTA. Carpet item G was made using 85% PET, and 15% N66 (RV=28, AEG=126) made by INVISTA.

The test yarns were then tufted into thirty ounce per square yard (30 oz/sq. yd); having 0.5 inch (1.3 cm) pile height cut pile carpets on a ⅛ inch gauge (0.318 cm) tufting machine.

Carpets made from items D, E, F, and G were evaluated using the abovementioned test methods for durability. Durability results are shown in Table 2.

TABLE 2

Durability Test Results

| Yarn item ID | Carpet avg. Vetterman 5k rating | Fiber MR | Fiber melt temperature, deg. C. | Fiber draw ratio |
|---|---|---|---|---|
| D | 1.5 | 2.6 | 290 | 4.2 |
| E | 3.2 | 1.9 | 290 | 3.4 |
| F | 2.2 | 2.0 | 290 | 3.4 |
| G | 2.5 | 1.8 | 290 | 3.4 |

Example 3

For yarn items H and I, yarn was spun as described by the Spinning Process, except that the PET and N66 resins were not physically mixed prior to polymer melt extrusion. Instead, yarn was made by feeding N66 polymer separately to the extruder. The PET resin (IV=0.83, 2% IPA) was from Auriga Polymers, Inc. (Spartanburg, S.C., USA). Yarn item H was made using 100% PET. Yarn item I was made using 85% PET, and 15% N66 (RV=25, AEG=38, 2% SIPA) made by INVISTA.

The test yarns were then tufted into thirty ounce per square yard (30 oz/sq. yd; having 0.5 inch (1.3 cm) pile height cut pile carpets on a ⅛ inch gauge (0.318 cm) tufting machine.

Carpets made from items H and I were evaluated using the abovementioned test methods for durability, and pile compression. Results are shown in Table 3.

TABLE 3

Durability Test Results

| Yarn item ID | Fiber Melt temperature, deg. C. | Fiber MR | Fiber draw ratio | Carpet Avg. Vetterman 5k rating | Carpet pile compression % |
|---|---|---|---|---|---|
| H | 297 | 1.9 | 4.2 | 2.8 | 7 |
| I | 297 | 1.8 | 3.2 | 3 | 7 |

Example 4

For yarn items J, K, L, and M, yarn was spun as described by the Spinning Process. Items J, K, L and M were made from 85% PET resin (IV=0.83, 2% IPA) from Auriga Polymers, Inc. (Spartanburg, S.C., USA). Item J was made using 15% N66 (RV=25, AEG=38, 2% SIPA). Items K, L, and M were made using 15% N66 (RV=45, AEG=57) made by INVISTA. A styrene-maleic anhydride copolymer named SMA® 9001 (Cray Valley, Inc., Exton, Pa., USA) was used as a compatibilizing additive in producing items L and M.

The test yarns were tufted into thirty ounce per square yard (30 oz/sq. yd; having 0.5 inch (1.3 cm) pile height cut pile carpets on a ⅛ inch gauge (0.318 cm) tufting machine. Carpets made using items J, K, L and M were evaluated using the abovementioned test method for soiling. Results are shown in Table 4.

TABLE 4

Durability Test Results

| Yarn item ID | Fiber melt temperature, deg. C. | Fiber MR | Fiber draw ratio | Use rate, SMA ® 9001 (ppm) | Carpet Avg. Vetterman 5k rating |
|---|---|---|---|---|---|
| J | 290 | 1.9 | 3.4 | 0 | 3.1 |
| K | 290 | 2.0 | 4.2 | 0 | 2.2 |
| L | 290 | 1.9 | 3.4 | 1000 | 3.0 |
| M | 290 | 2.0 | 3.4 | 3000 | 3.1 |

Items J and K show that use of N66 resin having a greater AEG value, such as used in generating item K, are impacted by the spinning process to give less durable fibers. The impact on durability is evidenced by testing carpets tufted from J and K; the carpet made using yarn item K performs more poorly, as shown by the soiling test ratings of J and K (3.1 and 2.2, respectively). Yarn items L and M, made using 1000 and 3000 ppm SMA® 9001, respectively, show that the carpet soiling deficiency can be overcome through the addition of a compatibilizing additive in the yarn during the Spinning Process, as shown by the soiling test ratings of K, L and M (2.2, 3.0 and 3.1, respectively).

Example 5

To demonstrate the process necessary for melt spinning operability in the absence of a compatibilizing additive, yarn items N and O were spun as described by the Spinning Process, except that the exit velocities were representative of exit velocities standard in the industry for polyester yarns. Items N and O were made from 85% PET resin (IV=0.83, 2% IPA) from Auriga Polymers, Inc. (Spartanburg, S.C., USA), and 15% N66 (RV=25, AEG=38, 2% SIPA) made by INVISTA. Melt spinning operability was determined on a pass/fail basis for N and O, and compared to that for items E, F, and G. Results are shown in Table 5.

TABLE 5

Soiling Test Results

| Yarn item ID | exit velocity, feet per minute | Melt spinning operability |
|---|---|---|
| E-G | 60.5 | Pass |
| N | 20.3 | Fail |
| O | 17 | Fail |

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also the individual concentrations (e.g., 1%, 2%, 3%, and 4%) and the sub-ranges (e.g., 0.5%, 1.1%, 2.2%, 3.3%, and 4.4%) within the indicated range. The term "about" can include ±1%, ±2%, ±3%, ±4%, ±5%, ±8%, or ±10%, of the numerical value(s) being modified. In addition, the phrase "about 'x' to 'y'" includes "about 'x' to about 'y'".

While the illustrative embodiments of the invention have been described with particularity, it will be understood that the invention is capable of other and different embodiments and that various other modifications will be apparent to and may be readily made by those skilled in the art without departing from the spirit and scope of the invention. Accordingly, it is not intended that the scope of the claims hereof be limited to the examples and descriptions set forth herein but rather that the claims be construed as encompassing all the features of patentable novelty which reside in the present disclosure, including all features which would be treated as equivalents thereof by those skilled in the art to which the invention pertains.

The invention claimed is:

1. A multipolymer fiber comprising:

a) A polyester phase formed from at least one polyester resin, present at between about 75 to about 95 percent by weight; and b) A polyamide phase formed from at least one polyamide resin with an amine end group content of about 40 meq/kg or less, present at between about 5 to about 25 percent by weight, wherein the polyamide phase is distinct from the polyester phase and comprises a plurality of polyamide fibrils dispersed in the polyester phase, wherein the polyamide fibrils are separately distinguishable from each other, and wherein the polyamide fibrils have an average diameter size in the range from about 100 nm to about 400 nm.

2. The multipolymer fiber of claim 1 wherein a majority of the polyamide fibrils are continuous fibrils that span the length of the multipolymer fiber.

3. The multipolymer fiber of claim 1 wherein a majority of the polyamide fibrils have an average length that is at least 10 times the average diameter of the polyamide fibrils.

4. The multipolymer fiber of claim 1 wherein a majority of the polyamide fibrils have an average length that is at least about 10,000 nm.

5. The multipolymer fiber of claim 1 wherein the multipolymer fiber is a bulk continuous filament fiber.

6. The multipolymer fiber of claim 1 wherein the at least one polyester resin is selected from the group consisting of polyethylene terephthalate, polytrimethylene terephthalate, polybutylene terephthalate, polyethylene naphthalate and blends or copolymers thereof.

7. The multipolymer fiber of claim 1 wherein the at least one polyamide resin is selected from the group consisting of nylon 6,6, nylon 6, nylon 7, nylon 11, nylon 12, nylon 6,10, nylon 6,12, nylon DT, nylon 6T, nylon 61 and blends or copolymers thereof.

8. The multipolymer fiber of claim 1 wherein the polyester resin is polyethylene terephthalate.

9. The multipolymer fiber of claim 1 wherein the polyamide resin is nylon 6,6.

10. The multipolymer fiber of claim 1 wherein the polyamide phase is formed from at least one polyamide resin with an RV in the range of about 20 to about 60, and amine end groups in the range of about 20 to about 40 meq/kg.

11. The multipolymer fiber of claim 1 wherein the polyamide phase is formed from at least one polyamide resin with sulfonated isophthalic acid content of about 0.01 to about 8 percent by weight.

12. The multipolymer fiber of claim 1 wherein the polyester phase is formed from at least one polyester resin with isophthalic acid content of about 0.01 to about 8 percent by weight.

13. The multipolymer fiber of claim 1 wherein there is sufficient interfacial bonding between the polyester phase and the polyamide phase to maintain fibril stability of the plurality of polyamide fibrils dispersed within the polyester phase.

14. The multipolymer fiber of claim 13 wherein more than about 25% of the polyamide fibrils will break on the same cross-sectional plane as the polyester phase when the multipolymer fiber is subject to a freeze fracture test.

15. The multipolymer fiber of claim 13 wherein more than about 50% the polyamide fibrils will break on the same cross-sectional plane as the polyester phase when the multipolymer fiber is subject to a freeze fracture test.

16. The multipolymer fiber of claim 1 further comprising a component selected from the group consisting of colorants, delustrants, catalysts, spin assists, dye level modifiers, anti-microbial agents, stabilizers, flame-retardants, anti-oxidants, acidic moieties conducive to cationic dyeing, and combinations thereof.

17. The multipolymer fiber of claim 1 wherein the polyamide phase is present at between about 10 to about 25 percent by weight of the multipolymer fiber.

18. The multipolymer fiber of claim 1 further comprising about 1% or less by weight of a compatibilizing agent.

19. A yarn comprising the multipolymer fiber of claim 1.

20. A textile comprising the yarn of claim 19.

21. A carpet comprising the yarn of claim 19.

22. A carpet of claim 21 wherein the vetterman-5K rating is 3 or greater when evaluated according to ASTM D5417.

23. A carpet of claim 21 wherein the pile compression is less than about 10%.

24. A method of making a multipolymer fiber, comprising:

a) combining at least one polyester resin and at least one polyamide resin with an amine end group content of about 40 meq/kg or less to form a polymer melt, wherein the at least one polyester resin is present from about 75 to about 95 percent by weight of the polymer melt and the at least one polyamide resin is present from about 5 to about 25 percent by weight of the polymer melt; and b) forming a multipolymer fiber from the polymer melt comprising a polyester phase and a polyamide phase, wherein the polyamide phase is distinct from the polyester phase and comprises a plurality of polyamide fibrils dispersed in the polyester phase, wherein the polyamide fibrils are separately distinguishable from each other and wherein the polyamide fibrils have an average diameter size in the range from about 100 nm to about 400 nm.

25. The method of claim 24 wherein the at least one polyester resin has a moisture content below about 100 ppm and the at least one polyamide resin has a moisture content below 500 ppm.

26. The method of claim 24 wherein the polymer melt is dried to a moisture content below about 100 ppm prior to step (b).

27. The method of claim 24 wherein step (b) further comprises forming the multipolymer fiber at a spin draw ratio of about 90 or lower.

28. The method of claim 24 wherein step (b) further comprises advancing the polymer melt through a spinneret capillary at an exit velocity of about 30 feet per minute or greater.

29. The method of claim 24 wherein step (b) further comprises advancing the polymer melt through a spinneret capillary at an exit velocity of about 40 feet per minute or greater.

30. The method of claim 24 wherein a majority of the polyamide fibrils are continuous fibrils that span the length of the multipolymer fiber.

31. The method of claim 24 wherein a majority of the polyamide fibrils have an average length that is at least 10 times the average diameter of the polyamide fibrils.

32. The method of claim 24 wherein a majority of the polyamide fibrils have an average length that is at least about 10,000 nm.

33. The method of claim 24 wherein the multipolymer fiber is a bulk continuous filament fiber.

34. The method of claim 24 wherein the at least one polyester resin is selected from the group consisting of polyethylene terephthalate, polytrimethylene terephthalate, polybutylene terephthalate, polyethylene naphthalate and blends or copolymers thereof.

35. The method of claim 24 wherein the at least one polyamide resin is selected from the group consisting of nylon 6,6, nylon 6, nylon 7, nylon 11, nylon 12, nylon 6,10, nylon 6,12, nylon DT, nylon 6T, nylon 61 and blends or copolymers thereof.

36. The method of claim 24 wherein the polyester resin is polyethylene terephthalate.

37. The method of claim 24 wherein the polyamide resin is nylon 6,6.

38. The method of claim 24 wherein the at least one polyamide resin has an RV in the range of about 20 to about 60, and amine end groups in the range of about 20 to about 40 meq/kg.

39. The method of claim 24 wherein at least one polyamide resin has a sulfonated isophthalic acid content of about 0.01 to about 8 percent by weight.

40. The method of claim 24 wherein the at least one polyester resin has an isophthalic acid content of about 0.01 to about 8 percent by weight.

41. The method of claim 24 wherein there is sufficient interfacial bonding between the polyester phase and the polyamide phase to maintain fibril stability of the plurality of polyamide fibrils dispersed within the polyester phase.

42. The method of claim 24 wherein more than about 25% of the polyamide fibrils will break on the same cross-sectional plane as the polyester phase when the multipolymer fiber is subject to a freeze fracture test.

43. The method of claim 24 wherein more than about 50% the polyamide fibrils will break on the same cross-sectional plane as the polyester phase when the multipolymer fiber is subject to a freeze fracture test.

44. The method of claim 24 the polymer melt further comprises a component selected from the group consisting of colorants, delustrants, catalysts, spin assists, dye level modifiers, anti-microbial agents, stabilizers, flame-retardants, antioxidants, acidic moieties conducive to cationic dyeing, and combinations thereof.

45. The method of claim 24 wherein the polyamide phase is present at between about 10 to about 25 percent by weight of the multipolymer fiber.

46. The method of claim 24 wherein the polymer melt further comprises about 1% or less by weight of a compatibilizing agent.

47. A yarn comprising the multipolymer fiber formed from the method of claim 24.

48. A textile comprising the yarn of claim 47.

49. A carpet comprising the yarn of claim 47.

50. A carpet of claim 49 wherein the vetterman-5K rating is 3 or greater when evaluated according to ASTM D5417.

51. A carpet of claim 50 wherein the pile compression is less than about 10%.

52. The method of claim 24 wherein the multipolymer fiber is formed by melt spinning.

* * * * *